US009871352B2

(12) United States Patent
Nakano et al.

(10) Patent No.: US 9,871,352 B2
(45) Date of Patent: Jan. 16, 2018

(54) SPARK PLUG

(71) Applicant: NGK Spark Plug Co., LTD., Nagoya (JP)

(72) Inventors: Seiji Nakano, Kasugai (JP); Kouta Yamauchi, Toki (JP); Hironori Uegaki, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/415,173

(22) Filed: Jan. 25, 2017

(65) Prior Publication Data

US 2017/0222405 A1 Aug. 3, 2017

(30) Foreign Application Priority Data

Jan. 28, 2016 (JP) ..... 2016-014842

(51) Int. Cl.
*H01T 13/34* (2006.01)
*H01T 21/02* (2006.01)

(52) U.S. Cl.
CPC ..... *H01T 13/34* (2013.01); *H01T 21/02* (2013.01)

(58) Field of Classification Search
None
See application file for complete search history.

(56) References Cited

U.S. PATENT DOCUMENTS 6,188,166 B1 * 2/2001 Nishikawa ..... H01T 13/34 313/141
2006/0158081 A1 7/2006 Shibata et al.
2006/0220510 A1 10/2006 Shibata
2013/0328477 A1 * 12/2013 Katsuraya ..... H01T 13/20 313/145

FOREIGN PATENT DOCUMENTS

JP 2010-135345 A 6/2010

OTHER PUBLICATIONS

Extended European Search Report dated Jun. 22, 2017 for the corresponding European Patent Application No. 17152885.4.

* cited by examiner

*Primary Examiner* — Ashok Patel
(74) *Attorney, Agent, or Firm* — Leason Ellis LLP

(57) ABSTRACT

The spark plug includes: an insulator having a through hole that penetrates therethrough along an axial direction; a center electrode disposed on one end side of the through hole; a metal terminal disposed on the other end side of the through hole; and a conductive seal layer connected to at least one of the center electrode and the metal terminal. The conductive seal layer contains glass and a Cu—Zn alloy. A volumetric percentage of the Cu—Zn alloy in the conductive seal layer is greater than or equal to 44% and not greater than 55%.

4 Claims, 3 Drawing Sheets

SPARK PLUG

This application claims the benefit of Japanese Patent Application No. 2016-014842, filed Jan. 28, 2016, which is incorporated herein in its entirety by reference.

FIELD OF THE INVENTION

The present specification relates to a spark plug for igniting fuel gas in an internal combustion engine or the like.

BACKGROUND OF THE INVENTION

To date, in a spark plug used for an internal combustion engine, a conductive seal layer is filled between a center electrode disposed at a front end side portion in a through hole of an insulator, and a member (for example, a resistor for removing noise) in the through hole on the side rearward of the center electrode. Thus, the center electrode is fixed in the insulator, and conductivity between the center electrode and the member on the side rearward thereof, and airtightness in the through hole are assured. For example, a conductive seal layer disclosed in Japanese Patent Application Laid-Open (kokai) No. 2010-135345 is formed by using conductive glass powder that contains Cu—Zn alloy powder the content of which is greater than 30% by mass and less than 75% by mass.

Problems to be Solved by the Invention

In recent years, due to output from an internal combustion engine being enhanced, load and impact on a spark plug tend to be increased, so that the spark plug is required to have improved impact resistance. Therefore, the conductive seal is required to assure conductivity and airtightness, and have a further improved impact resistance.

The present specification discloses a technique that allows a conductive seal to have an improved impact resistance in a spark plug used for an internal combustion engine.

SUMMARY OF THE INVENTION

Means for Solving the Problems

The technique disclosed in the present specification can be implemented as the following application examples.

APPLICATION EXAMPLE 1

A spark plug including:

an insulator having a through hole that penetrates therethrough along an axial direction;

a center electrode disposed on one end side of the through hole;

a metal terminal disposed on the other end side of the through hole; and a conductive seal layer connected to at least one of the center electrode and the metal terminal, in which the conductive seal layer contains glass and a Cu—Zn alloy, and a ratio of a volume (volumetric percentage) of the Cu—Zn alloy in the conductive seal layer is greater than or equal to 44% and not greater than 55%.

In the above configuration, the volumetric percentage of the Cu—Zn alloy in the conductive seal layer is greater than or equal to 44%, thereby improving adhesiveness between the conductive seal layer, and the center electrode or the metal terminal. Further, the volumetric percentage of the Cu—Zn alloy in the conductive seal layer is not greater than 55%, whereby glass is appropriately filled in gaps of the Cu—Zn alloy. Therefore, impact resistance of the conductive seal layer can be improved, so that the impact resistance of the spark plug can be improved.

APPLICATION EXAMPLE 2

A method for manufacturing a spark plug, the spark plug including:

an insulator having a through hole that penetrates therethrough along an axial direction;

a center electrode disposed on one end side of the through hole;

a metal terminal disposed on the other end side of the through hole; and a conductive seal layer connected to at least one of the center electrode and the metal terminal, the method including:

charging raw material powder containing glass powder and Cu—Zn alloy powder, into the through hole of the insulator, and forming the conductive seal layer by softening the raw material powder having been charged into the through hole, in which a ratio of a volume of (volumetric percentage) the Cu—Zn alloy powder in the raw material powder is greater than or equal to 44% and not greater than 55%.

In the above configuration, the volumetric percentage of the Cu—Zn alloy powder in the raw material powder is greater than or equal to 44%, thereby improving adhesiveness between the conductive seal layer to be formed, and the center electrode or the metal terminal. Further, the volumetric percentage of the Cu—Zn alloy powder in the raw material powder is not greater than 55%, whereby glass is appropriately filled in gaps of the Cu—Zn alloy in the conductive seal layer to be formed. Therefore, impact resistance of the conductive seal layer to be formed can be improved.

APPLICATION EXAMPLE 3

The method for manufacturing the spark plug according to Application example 2, in which a particle size of the glass powder is greater than or equal to 25 μm and less than 75 μm.

In the above configuration, the particle size of the glass powder is greater than or equal to 25 μm, whereby reduction in operability for manufacturing can be inhibited. Further, the particle size of the glass powder is less than 75 μm, whereby sinterability for the conductive seal layer to be formed can be improved.

The present invention can be implemented in various forms. For example, the present invention can be implemented as a spark plug, an ignition system using the spark plug, an internal combustion engine having the spark plug mounted therein, an internal combustion engine in which the ignition system using the spark plug is mounted, or the like.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

[Modes for Carrying Out the Invention]

Figure 1:
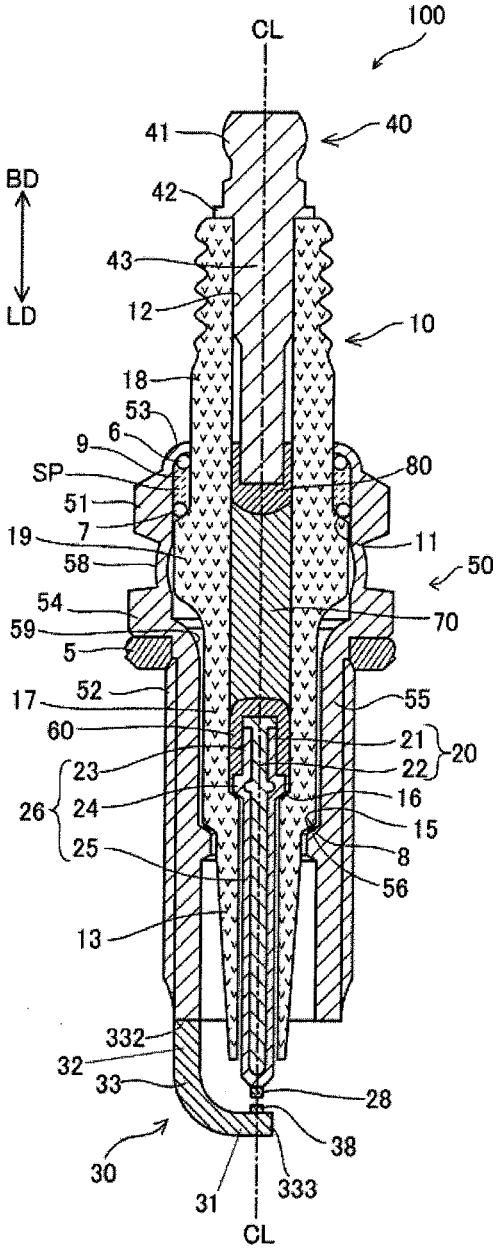
FIG. 1 is a cross-sectional view of an example of a spark plug according to an embodiment.

A. Embodiment:

A-1. Structure of Spark Plug:

FIG. 1 is a cross-sectional view of an example of a spark plug according to an embodiment. A line CL illustrated therein represents an axis CL (also referred to as the central axis CL) of a spark plug 100. The illustrated cross-section is a cross-section that includes the axis CL. Hereinafter, the direction parallel to the axis CL is also referred to as "axial direction". Among the directions parallel to the axis CL, the downward direction in FIG. 1 is also referred to as a front end direction LD, and the upward direction in FIG. 1 is also referred to as a rear end direction BD. The front end direction LD is a direction from a metal terminal 40 described below toward electrodes 20, 30 described below. Further, a radial direction of a circle, around the axis CL, on a plane perpendicular to the axis CL is simply referred to as "radial direction", and the circumferential direction of the circle is simply referred to as "circumferential direction". The end in the front end direction LD is simply referred to as a front end, and the end in the rear end direction BD is simply referred to as a rear end.

The spark plug 100 includes an insulator 10, a center electrode 20, a ground electrode 30, a metal terminal 40, a metal shell 50, a first conductive seal layer 60, a resistor 70, a second conductive seal layer 80, a first packing 8, a talc 9, a second packing 6, and a third packing 7.

The insulator 10 is a substantially cylindrical member having a through hole 12 which extends along the axial direction and penetrates through the insulator 10. The insulator 10 is formed by alumina being sintered (another insulating material may be used). The insulator 10 includes a leg portion 13, a first reduced outer diameter portion 15, a first trunk portion 17, a flange portion 19, a second reduced outer diameter portion 11, and a second trunk portion 18, which are arranged in order, respectively, in the rear end direction BD. The outer diameter of the first reduced outer diameter portion 15 is gradually reduced in the front end direction LD. Inside the insulator 10, a reduced inner diameter portion 16 that has its inner diameter gradually reduced in the front end direction LD is formed near the first reduced outer diameter portion 15 (in the first trunk portion 17 in the example shown in FIG. 1). The outer diameter of the second reduced outer diameter portion 11 is gradually reduced in the rear end direction BD.

The center electrode 20 is disposed in the through hole 12 of the insulator 10 on the front end side thereof. The center electrode 20 is a rod-shaped member that extends along the axial direction. The center electrode 20 includes a center electrode tip 28 and a center electrode body 26.

The center electrode body 26 includes a leg portion 25, a flange portion 24, and a head portion 23, which are arranged in order, respectively, in the rear end direction BD. The front end side portion of the leg portion 25 is exposed to the outside of the through hole 12 on the front end side of the insulator 10. The other portions of the center electrode 20 are disposed in the through hole 12. The surface, of the flange portion 24, on the front end side is supported by the reduced inner diameter portion 16 of the insulator 10. Further, the center electrode 20 includes an electrode base material 21, and a core material 22 embedded in the electrode base material 21. The electrode base material 21 is formed by using, for example, nickel (Ni) or an alloy (for example, NCF600, NCF601) containing nickel as a main component. The "main component" means the component of which the content is highest (the same applies to the "main component" described below). The core material 22 is formed of a material (for example, an alloy containing copper) having a coefficient of thermal conductivity which is higher than the electrode base material 21.

The center electrode tip 28 is joined to the front end portion of the leg portion 25 of the center electrode body 26 by, for example, laser welding. The center electrode tip 28 is formed of a material containing, as a main component, a noble metal having a high melting point. As the material of the center electrode tip 28, for example, iridium (Ir) or platinum (Pt), or an alloy containing Ir or Pt as a main component, is used.

The metal terminal 40 is disposed in the through hole 12 of the insulator 10 on the rear end side thereof. The metal terminal 40 is a rod-shaped member that extends along the axial direction, and is formed by using a conductive material (for example, a metal such as a low-carbon steel). The metal terminal 40 includes a cap mounting portion 41, a flange portion 42, and a leg portion 43, which are arranged in order, respectively, in the front end direction LD. The cap mounting portion 41 is exposed to the outside of the through hole 12 on the rear end side of the insulator 10. The leg portion 43 is inserted in the through hole 12 of the insulator 10.

The cylindrical resistor 70 is disposed between the metal terminal 40 and the center electrode 20 in the through hole 12 of the insulator 10. The resistor 70 has a function of reducing electric wave noise generated when spark occurs.

The first conductive seal layer 60 is a conductive seal layer that is disposed between the center electrode 20 and the resistor 70, and is connected to the rear end of the center electrode 20 and the front end of the resistor 70. The second conductive seal layer 80 is a conductive seal layer that is disposed between the metal terminal 40 and the resistor 70, and is connected to the front end of the metal terminal 40 and the rear end of the resistor 70. As a result, the center electrode 20 and the metal terminal 40 are electrically connected via the resistor 70 and the conductive seal layers 60 and 80. The conductive seal layers 60 and 80 are used, whereby contact resistance between the materials 20, 60, 70, 80, and 40 which are layered, is stabilized, and a value of electric resistance between the center electrode 20 and the metal terminal 40 can be stabilized. Materials of the resistor 70, and the conductive seal layers 60 and 80 will be described below in detail.

The metal shell 50 is a substantially cylindrical member that has an insertion hole 59 that extends along the axis CL and penetrates through the metal shell 50. The metal shell 50 is formed by using a low-carbon steel material (another conductive material (for example, metal material) may be used). The insulator 10 is inserted in the insertion hole 59 of the metal shell 50. The metal shell 50 is fixed to the insulator 10 so as to be disposed around the insulator 10 in the radial direction. On the front end side of the metal shell 50, the end portion, of the insulator 10, on the front end side (a portion, of the leg portion 13, on the front end side in the present embodiment) is exposed to the outside of the insertion hole 59. On the rear end side of the metal shell 50, an end portion, of the insulator 10, on the rear end side (a portion, of the second trunk portion 18, on the rear end side in the present embodiment) is exposed to the outside of the insertion hole 59.

The metal shell 50 includes a trunk portion 55, a seat portion 54, a deformable portion 58, a tool engagement portion 51, and a crimp portion 53, which are arranged in order, respectively, in the rear end direction BD. The seat portion 54 is a flange-shaped portion. On the outer circumferential surface of the trunk portion 55, a screw portion 52 is formed so as to be screwed into a mounting hole of an internal combustion engine (for example, gasoline engine). An annular gasket 5 formed by a metal plate being bent is fitted between the seat portion 54 and the screw portion 52.

The metal shell 50 has a reduced inner diameter portion 56 disposed on the side forward of the deformable portion 58. The inner diameter of the reduced inner diameter portion 56 is gradually reduced from the rear end side in the front end direction LD. The first packing 8 is sandwiched between the reduced inner diameter portion 56 of the metal shell 50 and the first reduced outer diameter portion 15 of the insulator 10. The first packing 8 is an O-ring made of iron (another material (for example, metal material such as copper) may be used).

The tool engagement portion 51 has a shape that allows a spark plug wrench to engage therewith (for example, hexagonal columnar shape). On the rear end side of the tool engagement portion 51, the crimp portion 53 is formed. The crimp portion 53 is disposed on the side rearward of the second reduced outer diameter portion 11 of the insulator 10, and forms the end, of the metal shell 50, on the rear end side. The crimp portion 53 is bent inward in the radial direction.

On the rear end side of the metal shell 50, an annular space SP is formed between the inner circumferential surface of the metal shell 50 and the outer circumferential surface of the insulator 10. In the present embodiment, the space SP is surrounded by the crimp portion 53 and the tool engagement portion 51 of the metal shell 50, and the second reduced outer diameter portion 11 and the second trunk portion 18 of the insulator 10. On the rear end side of the space SP, the second packing 6 is disposed. On the front end side of the space SP, the third packing 7 is disposed. In the present embodiment, the packings 6 and 7 are each a C-ring made of iron (another material may be used). Powder of the talc 9 is filled between the two packings 6 and 7 in the space SP.

When the spark plug 100 is manufactured, the crimp portion 53 is crimped so as to be bent inward. The crimp portion 53 is pressed toward the front end side. Thus, the deformable portion 58 is deformed, and the insulator 10 is pressed toward the front end side, in the metal shell 50, through the packings 6 and 7 and the talc 9. The first packing 8 is pressed between the first reduced outer diameter portion 15 and the reduced inner diameter portion 56, and seals a portion between the metal shell 50 and the insulator 10. Thus, gas in a combustion chamber of the internal combustion engine is inhibited from leaking outward through between the metal shell 50 and the insulator 10. Further, the metal shell 50 is fixed to the insulator 10.

The ground electrode 30 is joined to the end, of the metal shell 50, on the front end side. The ground electrode 30 includes a ground electrode base material 33 and a ground electrode tip 38. In the present embodiment, the ground electrode base material 33 is a rod-shaped member. One end of the ground electrode base material 33 is a connection end 332 that is electrically connected to the end, of the metal shell 50, on the front end side by, for example, resistance welding. The other end of the ground electrode base material 33 is a free end 333. The ground electrode base material 33 extends in the front end direction LD from the connection end 332 connected to the metal shell 50, and is bent toward the axis CL. The ground electrode base material 33 extends to the free end 333 in the direction perpendicular to the axis CL. The ground electrode base material 33 is formed by using, for example, Ni or an alloy (for example, NCF600, NCF601) containing Ni as a main component. The ground electrode base material 33 may have a two-layer structure that includes a surface portion forming the surface, and a core portion embedded in the surface portion. In this case, the surface portion is formed by using, for example, Ni or an alloy containing Ni as a main component, and the core portion is formed by using a material (for example, pure copper) having a coefficient of thermal conductivity which is higher than the surface portion.

One side surface, extending in the direction perpendicular to the axis CL, of a portion of the ground electrode base material 33 on the free end 333 side opposes the center electrode tip 28 on the axis CL in the axial direction. The ground electrode tip 38 is welded to the one side surface of a base material front end portion 31 at a position opposing the center electrode tip 28 by resistance welding. For the ground electrode tip 38, for example, Pt (platinum) or an alloy containing Pt as a main component is used, specifically, Pt-20Ir alloy (platinum alloy containing 20% by mass of iridium) or the like is used. A spark gap is formed between paired electrode tips 28 and 38.

A-2. Method for Manufacturing Spark Plug:

The spark plug 100 described above can be manufactured by, for example, a manufacturing method described below. Firstly, an insulator assembly (assembly in which the center electrode 20, the metal terminal 40, the resistor 70, and the like are mounted to the insulator 10) produced in the process steps described below, the metal shell 50, and the ground electrode 30 are prepared. The metal shell 50 is mounted to the outer circumference of the insulator assembly, and a base material base end portion 32 of the ground electrode 30 is joined to the front end surface of the metal shell 50. To the base material front end portion 31 of the ground electrode 30 joined to the metal shell 50, the ground electrode tip 38 is welded. Thereafter, the ground electrode 30 is bent such that the base material front end portion 31 of the ground electrode 30 opposes the front end portion of the center electrode 20, to complete the spark plug 100.

Figure 2:
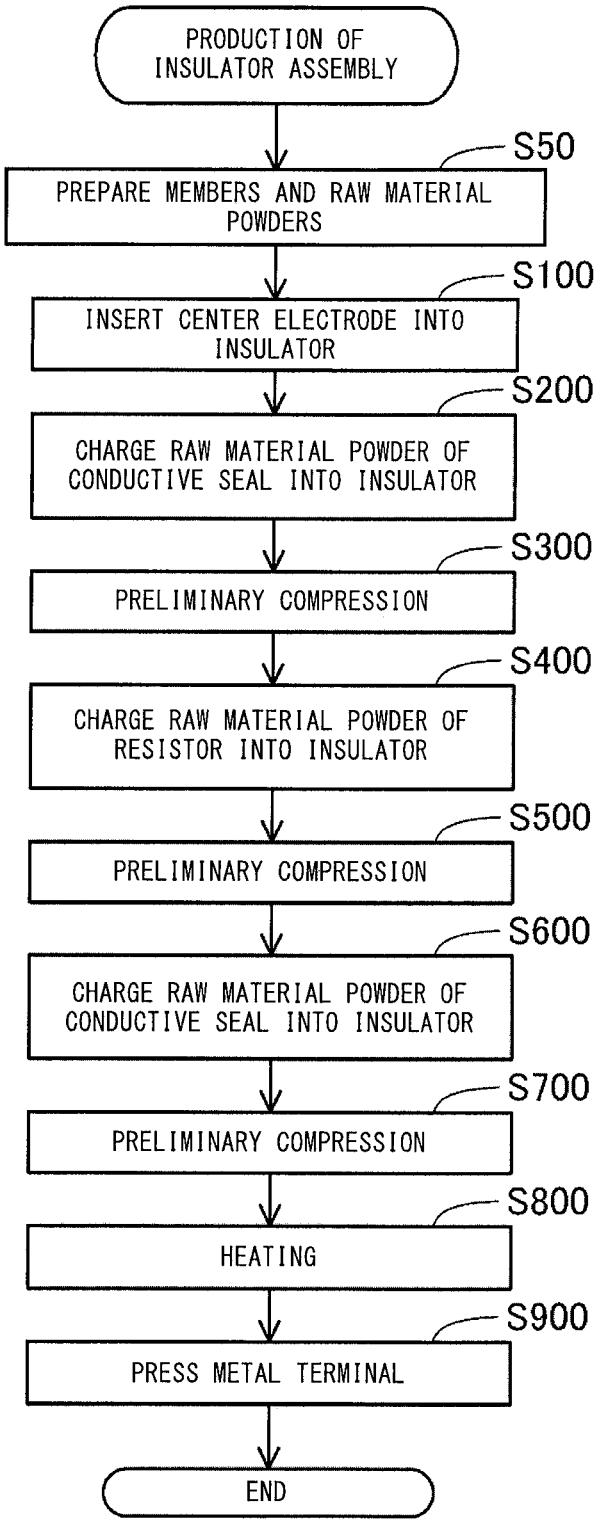
FIG. 2 is a flow chart showing a process of producing an insulator assembly.

A process of producing the insulator assembly will be described. FIG. 2 is a flow chart showing a process of producing the insulator assembly. FIGS. 3A-3E illustrate the production of the insulator assembly. In S50, necessary members and raw material powders are prepared, specifically, the insulator 10, the center electrode 20 having the center electrode tip 28 joined to its front end, the metal terminal 40, and raw material powders 65, 85, 75 of the conductive seal layers 60 and 80 and the resistor 70, respectively, are prepared. The raw material powder 75 of the resistor 70 is a mixture in which, for example, glass (for example, $B_2O_3$—$SiO_2$-based glass) powder as a main component, ceramic powder (for example, $TiO_2$), and metal powder (for example, Mg) are mixed. Thus, the resistor 70 is formed as a material in which ceramic particles and metal particles are dispersed in the glass. The raw material powders 65 and 85 of the conductive seal layers 60 and 80 will be described below.

Figure 3A:
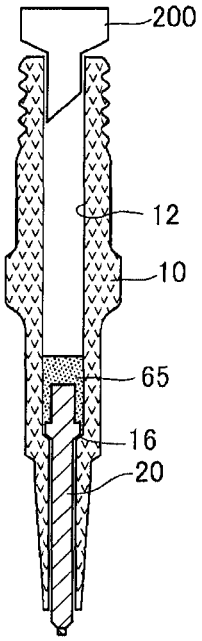
FIGS. 3A to 3E are views illustrating the production of the insulator assembly.

In S100, the center electrode 20 is inserted through an opening at the rear end into the through hole 12 of the insulator 10 which has been prepared (FIG. 3(A)). The center electrode 20 is supported by the reduced inner diameter portion of the insulator 10 and fixed in the through hole 12.

In S200, the raw material powder 65 of the first conductive seal layer 60 is charged into the through hole 12 of the insulator 10 through the opening at the rear end, that is, from above the center electrode 20 (FIG. 3(A)). The raw material powder 65 is charged thereinto by using, for example, a funnel 200.

Figure 3B:
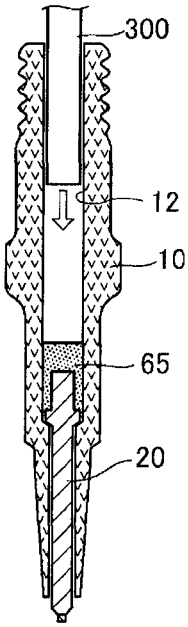

In S300, preliminary compression is performed on the raw material powder 65 having been charged into the through hole 12 (FIG. 3(B)). The preliminary compression is performed by the raw material powder 65 being compressed using a compression bar member 300 having an outer diameter that is slightly smaller than the inner diameter, of the through hole 12, on the rear end side.

In S400, the raw material powder 75 of the resistor 70 is charged, by using the funnel 200, into the through hole 12 of the insulator 10 through the opening at the rear end, that is, from above the raw material powder 65. In S500, as in S300 described above, the preliminary compression is performed, by using the compression bar member 300, on the raw material powder 75 having been charged into the through hole 12. The charging (S400) of the raw material powder 75 and the preliminary compression (S500) can be each performed a plurality of times. For example, charging the raw material powder 75 by half a specified amount to be charged and the preliminary compression after the charging are alternately performed such that the charging and the preliminary compression are each performed twice.

In S600, the raw material powder 85 of the second conductive seal layer 80 is charged, by using the funnel 200, into the through hole 12 of the insulator 10 through the opening at the rear end, that is, from above the raw material powder 75. In S700, as in S300 described above, the preliminary compression is performed, by using the compression bar member 300, on the raw material powder 85 having been charged into the through hole 12.

Figure 3C:
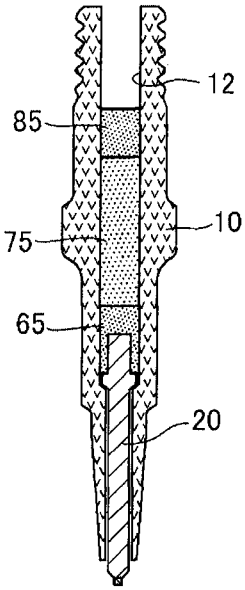

FIG. 3(C) illustrates the insulator 10, and the center electrode 20 having been inserted into the through hole 12 of the insulator 10, and the raw material powders 65, 75, and 85 having been charged into the through hole 12 of the insulator 10, at a time when the process steps up to S700 have ended.

In S800, the insulator 10 is transferred into a furnace, and heated to a predetermined temperature. The predetermined temperature is, for example, a temperature higher than a softening point of the glass component contained in the raw material powders 65, 75, and 85, specifically, 800 to 950 degrees centigrade.

Figure 3D:
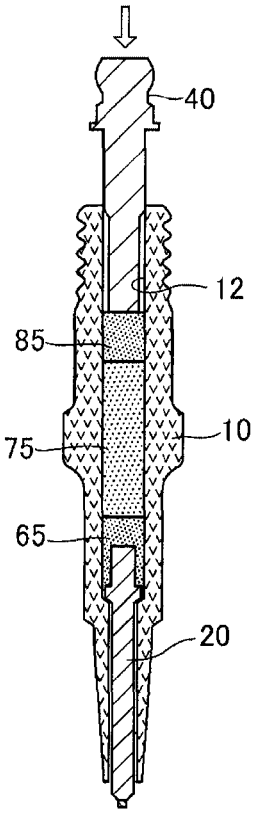
Figure 3E:
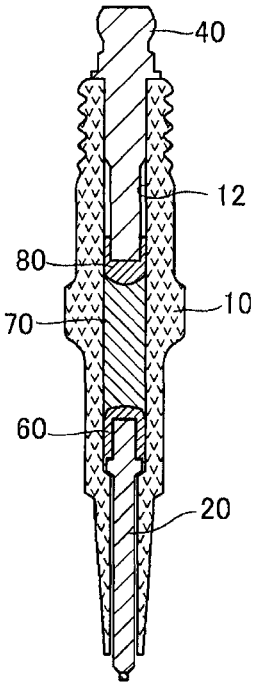

In S900, in a state where the insulator has been heated to the predetermined temperature, the metal terminal 40 is pressed in the axial direction through the opening at the rear end of the through hole 12 of the insulator 10 (FIG. 3(D)). As a result, the raw material powders 65, 75, and 85 which are layered in the through hole 12 of the insulator 10 are pressed (compressed) in the axial direction by the front end of the metal terminal 40. As a result, as shown in FIG. 3(E), the raw material powders 65, 75, and 85 are softened and sintered, whereby the first conductive seal layer 60, the resistor 70, and the second conductive seal layer 80, respectively, as described above, are formed. Through the above-described process steps, the insulator assembly is completed.

A-3. Material of Conductive Seal Layers 60 and 80

The raw material powders 65 and 85 of the conductive seal layers 60 and 80 formed in the above method are each a mixture in which glass powder and Cu—Zn alloy powder are mixed. A ratio of the volume of the Cu—Zn alloy powder in the raw material powder 65 is greater than or equal to 44% and not greater than 55%. The ratio of the volume of components (for example, inevitable impurities) other than the glass powder and the Cu—Zn alloy powder in each of the raw material powders 65 and 85, is, for example, less than or equal to 3%.

The glass powder is, for example, powder of $B_2O_3$—$SiO_2$-based glass. The glass powder may be, for example, powder of $Na_2O$—$SiO_2$-based glass or powder of CaO—BaO—$SiO_2$-based glass.

In the Cu—Zn alloy, the content (the unit is % by mass) of copper (Cu) is preferably greatest, and the content of zinc (Zn) is preferably second greatest. Further, in the Cu—Zn alloy, the content of components other than Cu and Zn, for example, the content of inevitable impurities is preferably less than 1%. Further, in the Cu—Zn alloy, the content of zinc (Zn) is preferably 5 to 40% by mass.

As a result, the conductive seal layers 60 and 80 are each formed of a material in which particles of the Cu—Zn alloy are dispersed in the glass having been melted and solidified. The conductive seal layers 60 and 80 have the same component ratios as the raw material powders 65 and 85, respectively. Therefore, the ratio of the volume of the Cu—Zn alloy in each of the conductive seal layers 60 and 80 is the same as the ratio of the volume of the Cu—Zn alloy powder in each of the raw material powders 65 and 85, respectively. That is, the ratio of the volume of the Cu—Zn alloy in each of the conductive seal layers 60 and 80 is greater than or equal to 44% and not greater than 55%. As a result, impact resistance of the conductive seal layers 60 and 80 can be improved, so that impact resistance of the spark plug can be improved.

More specifically, increase of the ratio of the volume of the Cu—Zn alloy having a compatibility, with the center electrode 20 and the metal terminal 40 made of metal, which is higher than glass, allows, according to the increase, enhancement of adhesiveness between the center electrode 20 and the first conductive seal layer 60, and adhesiveness between the metal terminal 40 and the second conductive seal layer 80. In the present embodiment, the ratio of the volume of the Cu—Zn alloy in each of the conductive seal layers 60 and 80 is greater than or equal to 44%, thereby enhancing adhesiveness between the conductive seal layer 60, 80, and the center electrode 20 or the metal terminal 40. Further, the glass functions as a binder that is filled among particles of the Cu—Zn alloy in each of the conductive seal layers 60 and 80, to integrally form each of the conductive seal layers 60 and 80. In a case where the ratio of the volume of the glass in each of the conductive seal layers 60 and 80 is excessively small, in other words, in a case where the ratio of the volume of the Cu—Zn alloy in each of the conductive seal layers 60 and 80 is excessively great, the glass cannot function as the binder, and integrality of each of the conductive seal layers 60 and 80 is reduced. In the present embodiment, the ratio of the volume of the Cu—Zn alloy in each of the conductive seal layers 60 and 80 is not greater than 55%, whereby the glass is appropriately filled in gaps of the Cu—Zn alloy, and integrality of each of the conductive seal layers 60 and 80 can be assured. As is understood from the above description, in the present embodiment, adhesiveness between the conductive seal layers 60, 80, and the center electrode 20 or the metal terminal 40 is enhanced, and integrality of each of the conductive seal layers 60 and 80 can be assured, thereby improving impact resistance of each of the conductive seal layers 60 and 80.

The ratio of the volume of the Cu—Zn alloy in each of the conductive seal layers 60 and 80 of the spark plug 100 can be specified as described below. The spark plug 100 is cut at a plane that includes the axis CL, and the cut surface is polished and etched, thereby obtaining a cross-section for observing the conductive seal layers 60 and 80. An enlarged photograph of the obtained cross-section for observation is used to calculate a ratio of an area of the Cu—Zn alloy to the entire area of each of the conductive seal layers 60 and 80 on the cross-section. The calculated ratio is used as the ratio of the volume of the Cu—Zn alloy in each of the conductive seal layers 60 and 80. When the distribution in the Cu—Zn alloy is determined as being not uniform on the cross-section of each of the conductive seal layers 60 and 80, the ratio of the area is calculated on each of a plurality of cross-sections, and the average value thereof is calculated as the ratio of the volume of the Cu—Zn alloy.

Further, in the present embodiment, the particle size of the glass powder contained in each of the raw material powders 65 and 85 is greater than or equal to 25 μm and less than 75 μm. As a result, sinterability of the conductive seal can be improved without reducing operability for manufacturing the spark plug 100.

More specifically, in a case where the particle size of the glass powder is excessively small, fluidity of the glass powder is reduced. Reduction of fluidity causes reduction of operability for process steps (S200, S600 in FIG. 2) of charging, by using the funnel 200, the glass powder into the through hole 12 of the insulator 10. Specifically, a malfunction in which the glass powder adheres to the inside of the funnel 200 and a time in which the glass powder passes through the funnel 200 is excessively increased, or a malfunction in which the glass powder adheres to an inner wall of the through hole 12 of the insulator 10 to prevent the glass powder from being efficiently charged, may occur. In the present embodiment, the particle size of the glass powder is greater than or equal to 25 μm, whereby such a malfunction is inhibited, and reduction in operability for the manufacturing can be inhibited. Meanwhile, in a case where the particle size of the glass powder is excessively great, the glass powder cannot be appropriately melted and solidified during the manufacturing. Thus, the glass powder is left as particles or the like in the conductive seal layers 60 and 80 to be formed, and a so-called sinterability is reduced. Reduction of the sinterability may cause reduction of airtightness of the conductive seal layers 60 and 80. In the present embodiment, the particle size of the glass powder is less than 75 μm, whereby sinterability of the conductive seal layers 60 and 80 to be formed can be improved.

For example, in a case where a mesh having openings each of which is 75 μm in size, and a mesh having openings each of which is 25 μm in size, are used to sieve the glass powder, the glass powder that passes through the mesh having the openings each of which is 75 μm in size, and does not pass through the mesh having the openings each of which is 25 μm in size can be used as the glass powder in which the particle size is greater than or equal to 25 μm and less than 75 μm.

A-4. First Evaluation Test

As indicated in Table 1, samples 1 to 11 of the spark plug were produced, and evaluation test for impact resistance was performed. Each sample was produced according to the manufacturing process. In the manufacturing process, among the samples, the ratio of the volume of the Cu—Zn alloy powder in each of the raw material powders 65 and 85 of the conductive seal layers 60 and 80 is different. Therefore, the ratio of the volume of the Cu—Zn alloy in each of the conductive seal layers 60 and 80 is different among the samples. Specifically, the ratio of the volume of the Cu—Zn alloy powder in each of the raw material powders 65 and 85 in the manufacturing, that is, the ratio of the volume of the Cu—Zn alloy in each of the conductive seal layers 60 and 80 in the sample is 38%, 42%, 43%, 44%, 45%, 48%, 50%, 53%, 55%, 58%, and 60% in samples 1 to 11, respectively (Table 1).

TABLE 1

| Sample No. | Ratio (%) of volume of Cu—Zn alloy | Impact resistance |
|---|---|---|
| 1 | 38 | C |
| 2 | 42 | C |
| 3 | 43 | C |
| 4 | 44 | B |
| 5 | 45 | B |
| 6 | 48 | A |
| 7 | 50 | B |
| 8 | 53 | B |
| 9 | 55 | B |
| 10 | 58 | C |
| 11 | 60 | C |

The following matters are the same among the samples.

The inner diameter of the through hole 12 of the insulator 10 (the outer diameter of each of the conductive seal layers 60 and 80): 3.0 mm The charged amount of the raw material powder 65 of the first conductive seal layer 60: 0.1 g The charged amount of the raw material powder 75 of the resistor 70: 0.1 g The charged amount of the raw material powder 85 of the second conductive seal layer 80: 0.5 g Heating temperature (S800 in FIG. 2): 900 degrees centigrade Particle size of the glass powder in each of the raw material powders 65 and 85: greater than or equal to 75 μm and less than 180 μm Component of the glass powder in each of the raw material powders 65 and 85: glass formed of 60% by mass of $SiO_2$, 30% by mass of $B_2O_3$, 5% by mass of $Na_2O$, and 5% by mass of BaO Cu—Zn alloy powder in each of the raw material powders 65 and 85: Cu-10Zn alloy formed of 90% by mass of Cu and 10% by mass of Zn In the first evaluation test, the impact resistance test specified in JIS:B8031 was performed for each sample, for 30 minutes, under the conditions that the vibration amplitude was 22 mm, and the number of times of impact was 400 times/minute. The resistance between the center electrode 20 and the metal terminal 40 was measured for each sample before and after the test. In a case where, due to the impact test, separation or the like occurs between the conductive seal layers 60, 80, and the center electrode 20 or the metal terminal 40, resistance is increased. Samples for which increase between the resistance before the test and the resistance after the test is less than 5% are evaluated as "A", samples for which increase therebetween is greater than or equal to 5% and less than 15% are evaluated as "B", and samples for which increase therebetween is greater than or equal to 15% are evaluated as "C".

As indicated in Table 1, samples 4 to 9 for which the ratio of the volume of the Cu—Zn alloy in each of the conductive seal layers 60 and 80 was greater than or equal to 44% and not greater than 55%, are evaluated as "B" or higher. Samples 1 to 3 for which the ratio of the volume of the Cu—Zn alloy was less than 44% are evaluated as "C". Samples 10 and 11 for which the ratio of the volume of the Cu—Zn alloy was greater than 55% are evaluated as "C". Thus, it can be confirmed that, in a case where the ratio of the volume of the Cu—Zn alloy is greater than or equal to 44% and not greater than 55%, impact resistance can be improved.

Further, in particular, sample 6 for which the ratio of the volume of the Cu—Zn alloy was 48% is evaluated as "A". Thus, it can be understood, according to the first evaluation test, that impact resistance can be particularly improved in a case where the ratio of the volume of the Cu—Zn alloy is 48%.

A-5. Second Evaluation Test

As indicated in Table 2, samples 12 to 23 of the spark plug were produced, and evaluation test for impact resistance was performed. The ratio of the volume of the Cu—Zn alloy was 44% in samples 12 to 15, the ratio of the volume of the Cu—Zn alloy was 48% in samples 16 to 19, and the ratio of the volume of the Cu—Zn alloy was 55% in samples 20 to 23 (Table 2). Further, the particle size of the glass powder in each of the raw material powders 65 and 85 was less than 25 μm in samples 12, 16, and 20, the particle size thereof was greater than or equal to 25 μm and less than 45 μm in samples 13, 17, and 21, the particle size thereof was greater than or equal to 45 μm and less than 75 μm in samples 14, 18, and 22, and the particle size thereof was greater than or equal to 75 μm in samples 15, 19, and 23 (Table 2). The other structures are the same as described for samples 1 to 11 in the first evaluation test. The glass powder having the particle sizes indicated in Table 2 was prepared by glass powder being sieved with the use of meshes having different opening sizes. For example, as glass powder having the particle size greater than or equal to 45 μm and less than 75 μm, the glass powder that passed through the mesh having openings each of which was 75 μm in size and did not pass through the mesh having openings each of which was 45 μm in size, was used.

TABLE 2

| Sample No. | Ratio of volume of Cu—Zn alloy (%) | Particle size of glass powder (μm) | Sinterability | Fluidity |
|---|---|---|---|---|
| 12 | 44 | less than 25 | A | B |
| 13 | | greater than or equal to 25 and less than 45 | A | A |
| 14 | | greater than or equal to 45 and less than 75 | A | A |
| 15 | | greater than or equal to 75 | B | A |
| 16 | 48 | less than 25 | A | B |
| 17 | | greater than or equal to 25 and less than 45 | A | A |
| 18 | | greater than or equal to 45 and less than 75 | A | A |
| 19 | | greater than or equal to 75 | B | A |
| 20 | 55 | less than 25 | A | B |
| 21 | | greater than or equal to 25 and less than 45 | A | A |
| 22 | | greater than or equal to 45 and less than 75 | A | A |
| 23 | | greater than or equal to 75 | B | A |

In the second evaluation test, test for sinterability and test for fluidity were performed.

In the test for sinterability, each sample was cut at a plane including the axis CL, and the cut surface was polished and etched, thereby obtaining a cross-section for observing the conductive seal layers 60 and 80. It was confirmed whether or not unmelted particles of the raw material powder containing the glass powder and the Cu—Zn alloy powder were contained, in each of the conductive seal layers 60 and 80, on the cross-section for observing the conductive seal layers 60 and 80. Samples for which it was confirmed that no particles of the raw material powder remained, are evaluated as "A", and samples for which it was confirmed that particles of the raw material powder remained, are evaluated as "B".

In the test for fluidity, a predetermined amount (specifically, 50 g) of the raw material powder used for each sample was put into a 50 cc measuring cylinder through a cone portion of a funnel. A time required until the raw material powder having been put therethrough passed through a foot portion (cylindrical portion) of the funnel and the entirety of the raw material powder flowed into the measuring cylinder, was measured. Samples for which the time required until the entirety of the glass powder flowed into the measuring cylinder was shorter than or equal to 20 seconds, are evaluated as "A", and samples for which the time was longer than 20 seconds are evaluated as "B".

As indicated in Table 2, samples 12 to 14, 16 to 18, and 20 to 22 in which the particle size of the glass powder was less than 75 μm are all evaluated as "A" for sinterability regardless of the ratio of the volume of the Cu—Zn alloy. Meanwhile, samples 15, 19, and 23 in which the particle size of the glass powder was greater than or equal to 75 μm are all evaluated as "B" for sinterability regardless of the ratio of the volume of the Cu—Zn alloy. Thus, it can be confirmed that the sinterability for the conductive seal layers 60 and 80 can be improved in a case where the particle size of the glass powder is less than 75 μm.

As indicated in Table 2, samples 13 to 15, 17 to 19, and 21 to 23 in which the particle size of the glass powder was greater than or equal to 25 μm, are all evaluated as "A" for fluidity regardless of the ratio of the volume of the Cu—Zn alloy. Meanwhile, samples 12, 16, and 20 in which the particle size of the glass powder was less than 25 μm are all evaluated as "B" for fluidity regardless of the ratio of the volume of the Cu—Zn alloy. Thus, it can be confirmed that the fluidity of the glass powder can be assured and operability for manufacturing the spark plug 100 can be thus assured in a case where the particle size of the glass powder is greater than or equal to 25 μm.

B. Modifications (1) The spark plug 100 according to the above embodiment has the resistor 70. However, the resistor 70 may not be provided. In this case, for example, one conductive seal layer is formed between the metal terminal 40 and the center electrode 20 in the through hole 12 of the insulator 10 so as to be connected to the metal terminal 40 and the metal shell 50. In this case, the one conductive seal layer preferably contains glass and a Cu—Zn alloy, and the ratio of the volume of the Cu—Zn alloy in the conductive seal layer is preferably greater than or equal to 44% and preferably not greater than 55%.

(2) In the spark plug 100 according to the above embodiment, both of the first conductive seal layer 60 and the second conductive seal layer 80 contain glass and the Cu—Zn alloy, and, in both of the first conductive seal layer 60 and the second conductive seal layer 80, the ratio of the volume of the Cu—Zn alloy is greater than or equal to 44% and not greater than 55%. Instead thereof, one of the first conductive seal layer 60 and the second conductive seal layer 80 may contain glass and the Cu—Zn alloy, or, in one of the first conductive seal layer 60 and the second conductive seal layer 80, the ratio of the volume of the Cu—Zn alloy may be greater than or equal to 44% and not greater than 55%. In this case, the other of the first conductive seal layer 60 and the second conductive seal layer 80 may have another structure, for example, a structure in which glass and a Cu alloy are contained. Alternatively, the other of the first conductive seal layer 60 and the second conductive seal layer 80 may contain glass and the Cu—Zn alloy such that the ratio of the volume of the Cu—Zn alloy is less than 44% or such that the ratio of the volume of the Cu—Zn alloy is greater than 55%.

(3) The specific structure of the spark plug 100 according to the above embodiment is an exemplary one. Another structure may be used. For example, a firing end of the spark plug may be variously structured. For example, the spark plug may be a so-called plasma jet plug in which spark (discharge) occurs in a gap positioned in a cavity, and gas in the cavity is excited, to generate plasma. Further, a spark plug in which a ground electrode and the center electrode 20 oppose each other in the direction perpendicular to the axis, to form a gap, may be used. Further, for example, the material of the insulator 10 or the material of the metal terminal 40 is not limited to the above material. For example, the insulator 10 may be formed by using a ceramic containing another compound (for example, AlN, $ZrO_2$, SiC, $TiO_2$, $Y_2O_3$) as a main component, instead of a ceramic containing alumina ($Al_2O_3$) as a main component.

The present invention has been described above with reference to the embodiment and the modifications. However, the present invention is not limited to the above embodiment and modifications at all, and may be embodied in various forms without departing from the gist of the invention.

DESCRIPTION OF REFERENCE NUMERALS

5: gasket; 6: second packing; 7: third packing; 8: first packing; 9: talc; 10: insulator; 11: second reduced outer diameter portion; 12: through hole; 13: leg portion; 15: first reduced outer diameter portion; 16: reduced inner diameter portion; 17: first trunk portion; 18: second trunk portion; 19: flange portion; 20: center electrode; 21: electrode base material; 22: core material; 23: head portion; 24: flange portion; 25: leg portion; 26: center electrode body; 28: center electrode tip; 30: ground electrode; 31: base material front end portion; 32: base material base end portion; 33: ground electrode base material; 38: ground electrode tip; 40: metal terminal; 41: cap mounting portion; 42: flange portion; 43: leg portion; 50: metal shell; 51: tool engagement portion; 52: screw portion; 53: crimp portion; 54: seat portion; 55: trunk portion; 56: reduced inner diameter portion; 58: deformable portion; 59: insertion hole; 60: first conductive seal layer; 65: raw material powder; 70: resistor; 75: raw material powder; 80: second conductive seal layer; 85: raw material powder; 100: spark plug; 200: funnel; 300: compression bar member

The invention claimed is:

1. A spark plug comprising:

an insulator having a through hole that penetrates therethrough along an axial direction;

a center electrode disposed on one end side of the through hole;

a metal terminal disposed on the other end side of the through hole; and a conductive seal layer connected to at least one of the center electrode and the metal terminal, wherein the conductive seal layer contains glass and a Cu—Zn alloy, and a volumetric percentage of the Cu—Zn alloy in the conductive seal layer is greater than or equal to 44% and not greater than 55%.

2. The spark plug according to claim 1, wherein the conductive seal layer is formed from raw material powders containing glass powder and Cu—Zn alloy powder.

3. The spark plug according to claim 2, wherein a particle size of the glass powder is 25 μm to 75 μm.

4. The spark plug according to claim 1, wherein the conductive seal layer contains Zn in an amount of 11%-40% by mass.

* * * * *